US011661828B2

(12) United States Patent
Conrad et al.

(10) Patent No.: US 11,661,828 B2
(45) Date of Patent: May 30, 2023

(54) CHARGING PUMP FOR ELECTRICAL SUBMERSIBLE PUMP GAS SEPARATOR

(71) Applicant: Baker Hughes Oilfield Operations LLC, Houston, TX (US)

(72) Inventors: Caleb Conrad, Anchorage, AK (US); Bryan C. Coates, Edmonton (CA)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/216,553

(22) Filed: Mar. 29, 2021

(65) Prior Publication Data

US 2021/0301636 A1 Sep. 30, 2021

Related U.S. Application Data

(60) Provisional application No. 63/001,908, filed on Mar. 30, 2020.

(51) Int. Cl.

| | |
|---|---|
| ***E21B 43/12*** | (2006.01) |
| ***F04D 13/10*** | (2006.01) |
| ***F04D 1/06*** | (2006.01) |
| ***E21B 43/38*** | (2006.01) |
| ***F04D 29/08*** | (2006.01) |

(52) U.S. Cl.

CPC ..... *E21B 43/128* (2013.01); *E21B 43/38* (2013.01); *F04D 1/06* (2013.01); *F04D 13/10* (2013.01); *F04D 29/086* (2013.01)

(58) Field of Classification Search

CPC ..... E21B 43/128; E21B 43/38; F04D 1/06; F04D 13/10; F04D 29/086; F04D 31/00

See application file for complete search history.

(56) References Cited

U.S. PATENT DOCUMENTS

| | | | | |
|---|---|---|---|---|
| 6,702,027 | B2 | 3/2004 | Olson et al. | |
| 7,814,969 | B2 | 10/2010 | Shaw | |
| 8,397,822 | B2 | 3/2013 | Tetzlaff et al. | |
| 9,938,806 | B2 | 4/2018 | Kirk et al. | |
| 2003/0155128 | A1* | 8/2003 | Gay | F04D 13/10 166/105 |
| 2009/0047157 | A1* | 2/2009 | Reid | E21B 33/12 417/423.3 |

(Continued)

OTHER PUBLICATIONS

International Search Report and Written Opinion of PCT Application No. PCT/US2021/070336 dated Jul. 7, 2021: pp. 1-12.

(Continued)

*Primary Examiner* — Blake Michener
*Assistant Examiner* — Yanick A Akaragwe
(74) *Attorney, Agent, or Firm* — Bracewell LLP; Keith R. Derrington

(57) ABSTRACT

An electrical submersible pump assembly (ESP) has a centrifugal production pump with production pump stages. A gas separator upstream is from the production pump. A centrifugal charge pump is upstream from the gas separator. The charge pump has charge pump stages and a discharge that leads to an intake of the gas separator. Each of the production pump stages has a higher lifting capacity than each of the charge pump stages. The impellers of the production pump stages have vane exit angles greater than vane exit angles of the impellers of the charge pump stages.

18 Claims, 5 Drawing Sheets

(56) References Cited

U.S. PATENT DOCUMENTS

| | | | | |
|---|---|---|---|---|
| 2010/0258306 | A1 | 10/2010 | Camilleri et al. | |
| 2016/0177684 | A1 | 6/2016 | Parks et al. | |
| 2016/0201444 | A1 | 7/2016 | Hardee et al. | |
| 2016/0222770 | A1* | 8/2016 | Kirk | E21B 43/38 |
| 2019/0017518 | A1 | 1/2019 | Brown et al. | |
| 2019/0162063 | A1* | 5/2019 | Brown | F04D 9/003 |
| 2019/0249537 | A1 | 8/2019 | Brown et al. | |
| 2021/0148380 | A1* | 5/2021 | Brown | F04D 9/003 |

OTHER PUBLICATIONS

Saudi Arabian 1st Examination Report for SA Application Serial No. 522440602; dated Mar. 25, 2023 (original and machine translation).

* cited by examiner

CHARGING PUMP FOR ELECTRICAL SUBMERSIBLE PUMP GAS SEPARATOR

CROSS REFERENCE TO RELATED APPLICATION

This application claims priority to provisional application Ser. No. 63/001,908, filed Mar. 30, 2020.

FIELD OF THE DISCLOSURE

This disclosure relates in general to electrical submersible pump (ESP) assemblies, and in particular to an ESP assembly with a gas separator located between a charge pump and a production pump.

BACKGROUND

A variety of pumps are used in oil producing wells to pump well fluid to a wellhead assembly at an upper end of the well. The well fluid often comprises water, oil and gas. A typical pump is a centrifugal pump having a large number of stages, each stage having an impeller and a diffuser. Centrifugal pumps have difficulty in pumping well fluids containing a large amount of gas. Gassy well ESP installations often employ a gas separator upstream from the production pump. The gas separator separates some of the gas from the liquid and discharges it into an annulus, typically outside of the production tubing.

While these systems work well, in some instances, the intake and discharge flow paths of the gas separator can become inverted, causing the gas separator to cease separating gas from liquid. This may occur due to low pressure of the well fluid flowing into the gas separator.

SUMMARY

An apparatus for pumping well fluid from a well comprises an electrical submersible pump assembly (ESP) having an electrical motor. A centrifugal production pump driven by the motor has a plurality of production pump stages. The motor also drives a gas separator upstream from the production pump and a centrifugal charge pump upstream from the gas separator. The charge pump has a plurality of charge pump stages and a discharge that leads to an intake of the gas separator.

Each of the production pump stages has a higher lifting capacity than each of the charge pump stages. More specifically, each of the production pump stages has an impeller with a vane exit angle relative to a longitudinal axis of the production pump. Each of the charge pump stages has an impeller with a vane exit angle relative to the longitudinal axis of the production pump that is less than the vane exit angle of the impeller of each of the production pump stages.

In one embodiment, the assembly includes a string of production tubing with a power cable wet mate device secured to the tubing. A power cable extends alongside an exterior of the tubing and down to the power cable wet mate device. An adapter on an upper end of the assembly couples to a wireline for lowering the assembly into the tubing. An annular seal arrangement seals between the production pump and the tubing. A motor wet mate device on the motor engages the power cable wet mate device. The gas separator secures to a lower end of the production pump, the charge pump secures to a lower end of the gas separator, and the motor is below the charge pump. A first port in the tubing below the wet mate devices directs upward flowing well fluid in the tubing outward into a tubing annulus surrounding the tubing. A second port in the tubing above the wet mate devices directs upward flowing well fluid in the tubing annulus into the tubing and to an intake of the charge pump. A third port in the tubing above the second port and below the annular seal arrangement directs separated gas from the gas separator outward into the tubing annulus. First, second and third sleeve valves may be employed to selectively open and close the first, second and third ports, respectively.

In another embodiment, a string of production tubing extends into the well. A power cable coiled tubing adapter on an upper end of the motor connects the assembly to a string of coiled tubing. The production pump is below the motor and has a production pump discharge for discharging well fluid into an assembly annulus in the tubing surrounding the assembly. The gas separator secures to a lower end of the production pump and has a gas separator discharge for discharging separated gas into the assembly annulus. The charge pump secures to a lower end of the gas separator. A seal arrangement seals between the tubing and the production pump below the production pump discharge and above the gas separator discharge. A port in the tubing below the seal arrangement directs separated gas from the gas separator discharge into a tubing annulus surrounding the tubing. Optionally, a sleeve valve may selectively opens and closes the port.

In a third embodiment, an outer conduit into which well fluid flows contains the assembly. The production pump has a production pump discharge for discharging well fluid into a string of tubing within the outer conduit. The gas separator has a separated liquid discharge coupled to an intake of the production pump and a separated gas discharge for discharging separated gas into the outer conduit. The charge pump has a charge pump discharge connected to an intake of the gas separator. The motor is within the outer conduit upstream from the charge pump. Optionally, a well fluid gravity separator may be at an upstream end of the charge pump for gravity separating gas from liquid in the well fluid flowing to the charge pump.

DETAILED DESCRIPTION OF THE DISCLOSURE

Figure 1A:
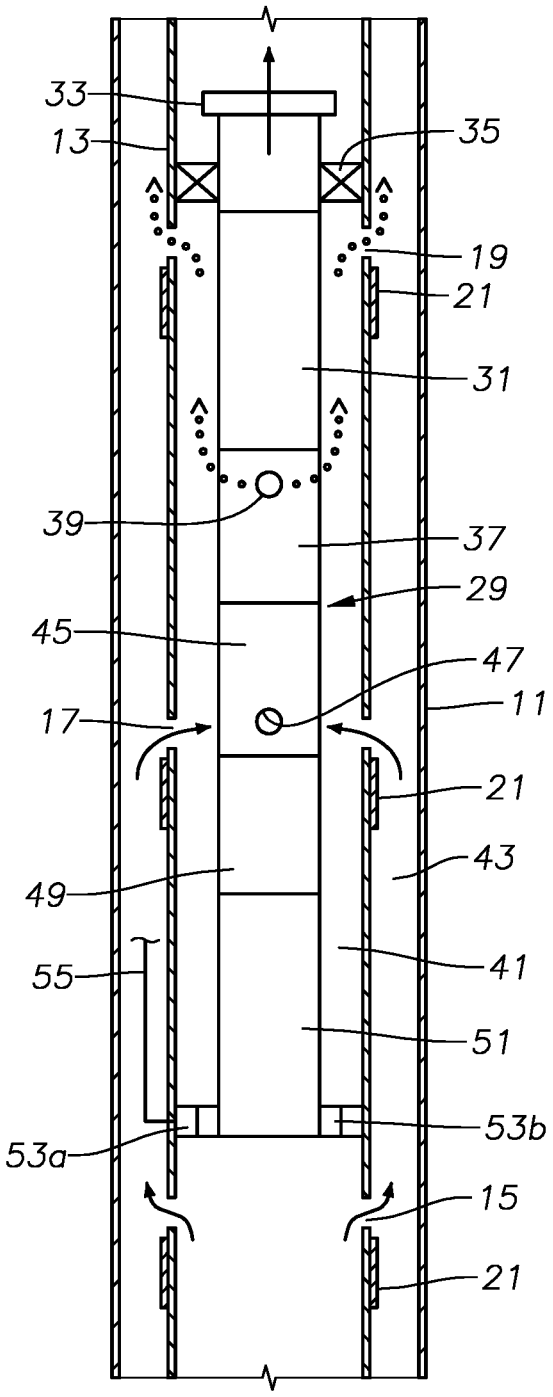
FIGS. 1A and 1B comprise a schematic side view of a thru-tubing wireline installed ESP installation in accordance with this disclosure.

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout. In an embodiment, usage of the term "about" includes +/−5% of the cited magnitude. In an embodiment, usage of the term "substantially" includes +/−5% of the cited magnitude. The terms "upper" and "lower" and the like bare used only for convenience as the well pump may operate in positions other than vertical, including in horizontal sections of a well.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Referring to FIG. 1A, a well has a conduit 11, typically casing cemented in place. A wellhead (not shown) supports a string of production tubing 13 in conduit 11. In this example, a lower portion of tubing 13 has three ports 15, 17, and 19 in its sidewall, spaced axially from each other. Each port 15, 17, and 19 may optionally have a sliding sleeve valve 21 to selectively open and close the port. Sliding sleeve valves 21 may be controlled from the surface, such as by hydraulic lines (not shown).

Figure 1B:
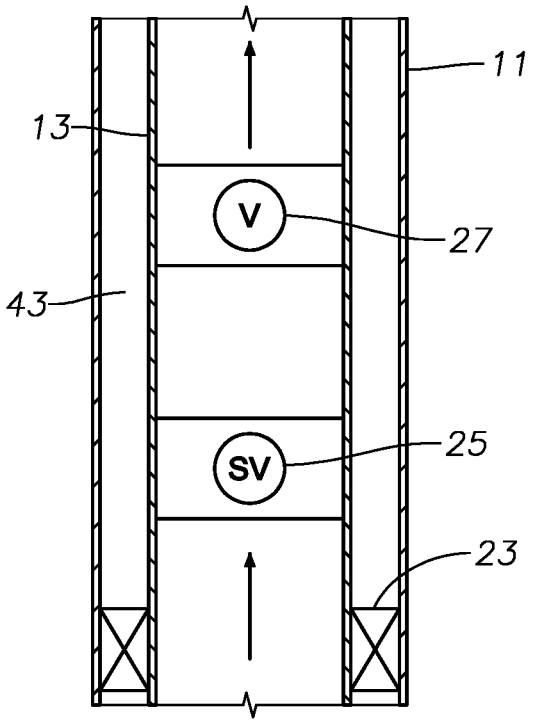

Referring to FIG. 1B, a packer 23 seals between tubing 13 and conduit 11 near the lower end of tubing 13, which is open to receive well fluid. Tubing 13 may have a conventional safety valve 25 and back up valve 27 above the open lower end. Safety valve 25 typically remains open in response to hydraulic fluid pressure in a line (not shown) leading to the wellhead. Back up valve 27 may also be hydraulically actuated.

Referring again to FIG. 1A, ESP assembly 29 has a production pump 31 with an adapter 33 on its upper end that includes a wireline fishing tool neck. Production pump discharges through adapter 33. A conventional wireline tool (not shown) on a string of wireline is employed to run and retrieve ESP assembly 29. The wireline tool releasably engages and disengages from adapter 33.

An annular seal member 35, which may be of various types, seals between production pump 31 and tubing 13. Seal member 35 is located above third port 19 in tubing 13. Seal member 35 may be a type that is lowered through tubing 13 along with ESP assembly 29, then set, such as by swelling.

A gas separator 37 for separating gas or lighter components from liquid or heavier components in the well fluid connects to the lower end of production pump 31. Gas separator 37 has a separated gas discharge 39 that discharges into an assembly annulus 41 between ESP assembly 29 and tubing 13. The separated gas is free to flow out third port 19 into a tubing annulus 43 between tubing 13 and conduit 11.

A charge pump 45 has its discharge connected to the intake of gas separator 37. Charge pump 45 has an intake 47 that receives well fluid flowing up ESP assembly annulus 41. Charge pump 45 increases the flowing pressure of the well fluid and discharges the well fluid into gas separator 37. Charge pump 45 is of a type that can more easily handle large amounts of gas than production pump 31. However, charge pump 45 will have less lifting capacity than production pump 31 for lifting a column of well fluid up tubing 13.

A seal section 49 has an upper end that secures to the lower end of charge pump 45 and a lower end that secures to the upper end of an electrical motor 51. Motor 51 is typically a three-phase electrical motor filled with a dielectric lubricant. A pressure equalizer, which may be in seal section 49, reduces a pressure differential between the dielectric lubricant and well fluid on the exterior of motor 51. Seal section 49 also seals around a drive shaft driven by motor 51 for driving charge pump 45, gas separator 37 and production pump 31.

A conventional electrical wet mate device (schematically illustrated) has an outer portion 53*a* mounted to tubing 13 and an inner portion 53*b* mounted to motor 51. An electrical power cable 55 extends from the wellhead alongside tubing 13 down to outer portion 53*a*. When running ESP assembly 29, inner portion 53*b* will slide into electrical engagement with outer portion 53*a*, establishing electrical continuity between power cable 55 and the windings of motor 51. Wet mate portions 53*a*, 53*b* are located above tubing first ports 15 and below tubing second ports 17. When engaged, wet mate portions 53*a*, 53*b* will restrict or block well fluid from flowing up tubing 13 to charge pump intake 47.

During operation, motor 51 will drive charge pump 45, gas separator 37 and production pump 31. As indicated by the solid arrows, well fluid containing gas and liquid flows up the lower end of tubing 13 and out first ports 15 into tubing annulus 43. The well fluid flows from tubing annulus 43 through tubing second ports 17 into assembly annulus 41. The well fluid flows from assembly annulus 41 into charge pump intake 47. Charge pump 45 increases the flowing pressure and discharges all of the well fluid into gas separator 37.

Gas separator 37 separates some of the lighter components, or gas, in the well fluid from liquid or heavier components. Gas separator 37 discharges the gas out separated gas discharge 39 into assembly annulus 41, as indicated by the dotted arrows. The gas flows from assembly annulus 41 through tubing third ports 19 into tubing annulus 43. The gas in tubing annulus 43 will migrate upward to the wellhead. Gas separator 37 discharges the heavier components of well fluid into production pump 31, which pumps that portion out the discharge in adapter 33 into tubing 13 above annular seal 35, as indicated by the dashed arrow.

Figure 2:
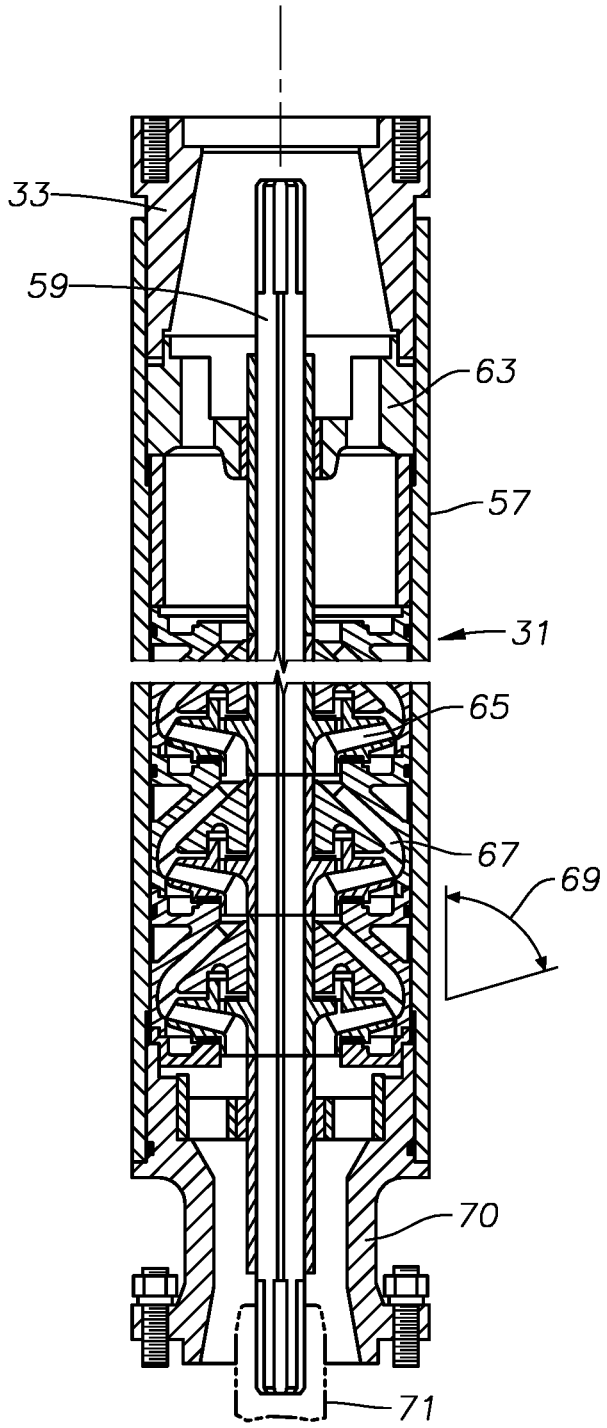
FIG. 2 is an enlarged, partly sectional view of a production pump of the ESP installation of FIG. 1.

FIG. 2 illustrates one example of production pump 31 removed from ESP assembly 29. Production pump 31 has a pump housing 57 containing a rotatable shaft 59 that extends along a longitudinal axis 61 of pump housing 57. Upper and lower bearings 63 radially support shaft 59. Production pump 31 is a conventional centrifugal pump with a large number of stages, each stage having an impeller 65 and a diffuser 67. Impellers 65 and diffusers 67 may be of a variety of types, including mixed flow types, as shown, radial flow types or even axial flow types. The mixed flow type shown has an impeller vane exit angle 69 relative to longitudinal axis 61 that is less than 90 degrees.

Production pump 31 has a base or intake 70 at its lower end that directs all of the liquid portions of the well fluid flowing from gas separator 37 (FIG. 3) into pump housing 57. A splined coupling 71 in base 70 connects production pump shaft 59 to drive shaft 72 of gas separator 37.

Figure 3:
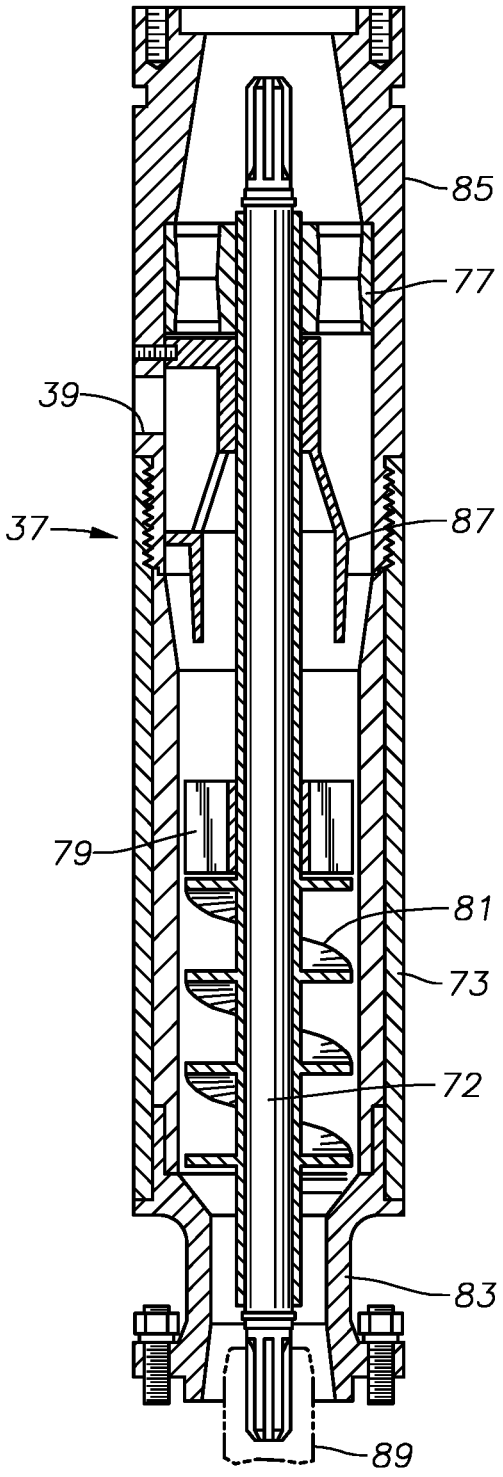
FIG. 3 is an enlarged, partly sectional view of a gas separator of the ESP installation of FIG. 1.

Referring to FIG. 3, gas separator 37 may be conventional, having a housing 73 in which shaft 72 rotates. Upper and lower bearings 77 provide radial support for gas separator shaft 72. Gas separator 37 has features to separate gas from liquid in the well fluid. In this example, the separation features include a set of vanes 79 keyed to shaft 72 for rotation in unison. Vanes 79 impart a swirling action to the well fluid, which results in the heavier, more liquefied portions of the well fluid moving outward relative to the axis of shaft 72. The lighter, more gaseous portions of the well fluid tend to remain more centered, closer to shaft 72.

An optional inducer 81 may be located below vanes 79. Inducer 81 is a screw pump having a helical flight, similar to an auger, for homogenizing the flow of well fluid toward vanes 79. Gas separator 37 has an intake or base 83 at its lower end that directs all of the well fluid flowing from charge pump 45 (FIG. 4) into the interior of gas separator housing 73. Gas separator 37 has a head 85 on its upper end that directs all of the separated liquid portion of the well fluid into production pump base 70 (FIG. 2).

A crossover 87 mounted in head 85 directs the lighter or more gaseous components of the well fluid out gas discharge 39. The heavier or more liquid components flow up head 85 into pump base 70 (FIG. 2). A coupling 89 on the lower end of gas separator shaft 72 connects to a driven shaft (not shown) of charge pump 45 (FIG. 4).

Figure 4:
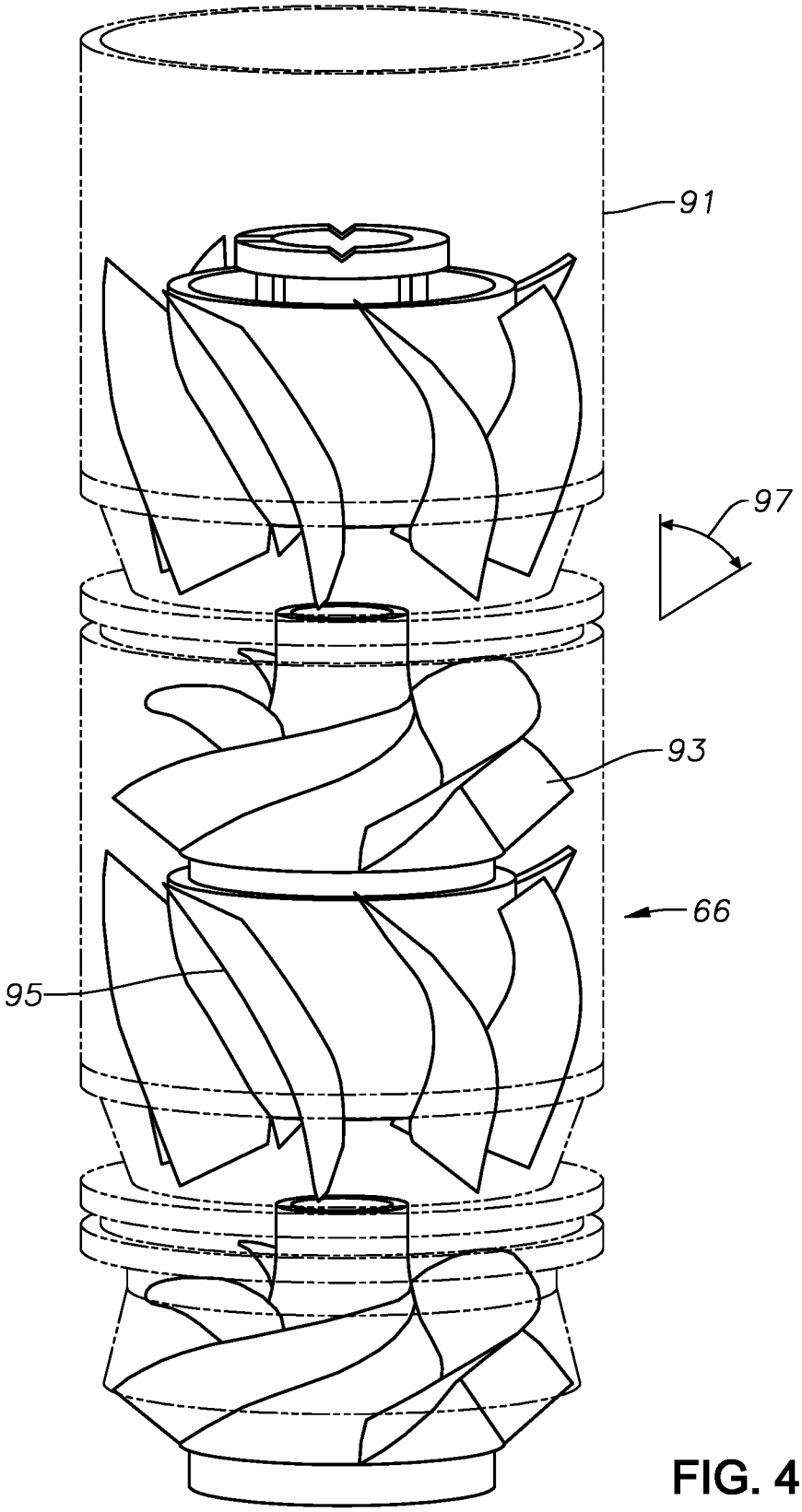
FIG. 4 is a schematic view of a gas separator charge pump for the ESP installation of FIG. 1.

Referring to FIG. 4, charge pump 45 may be a conventional centrifugal pump with a housing 91 containing a number of centrifugal pump stages. The number of pump stages in charge pump 45 may be the same or less than the number of pump stages in production pump 31 (FIG. 2). Each charge pump stage has an impeller 93 and a diffuser 95. Impellers 93 have exit angles 97 that are smaller than production pump impeller exit angles 69 (FIG. 2), thus charge pump 45 is more of an axial-flow type pump than production pump 31 (FIG. 2). The flow path in an axial flow pump is more axially directed than a radial flow pump, which directs the flow radially outward with each impeller and radially inward with each diffuser. The flow path is also more axially directed than in a mixed flow pump, which directs the flow outward and upward with each impeller and upward and inward with each diffuser.

Referring again to FIG. 2, production pump 31 may be a radial type, a mixed flow type as shown, or an axial flow type. A radial type (not shown) discharges well fluid from each impeller 65 approximately radially relative to axis 61. Thus a radial type has an impeller vane exit angle 69 relative to axis 61 that is near or at 90 degrees, greater than a mixed flow type. An axial flow type, such as illustrated by charge pump 45 (FIG. 4), has even a smaller exit angle 97 relative to axis 61 than exit angle 69 (FIG. 2) of a mixed flow type impeller. The greater radial exit angle 69 creates more lifting capacity than the smaller exit angle 97 to lift a column of well fluid. On the other hand, the smaller impeller exit angles 97 of charge pump 45 allows it to better pass through large volumes of gas than production pump 31.

Charge pump 45 can thus more efficiently pump well fluid containing a high gas percentage than production pump 31. However, each stage in charge pump 45 creates less pressure or lifting capability than each stage of production pump 31. As an example only, each stage of production pump 31 may have 1.5 to 2.0 times the lifting capability of each stage of charge pump 45. Stated another way, each stage of charge pump 45 may be capable of lifting 20-30 feet of a column of water, while each stage of production pump 31 may be capable of lifting 40-60 feet of a column of water. Correspondingly, and as an example only, charge pump 45 may be capable of efficiently pumping well fluid containing up to 60% of gas while production pump 31 may be capable of efficiently pumping well fluid containing only up to about 40% of gas. The flow pressure applied by charge pump 45 makes gas separator 37 more efficient in separating gas from liquid.

Figure 5A:
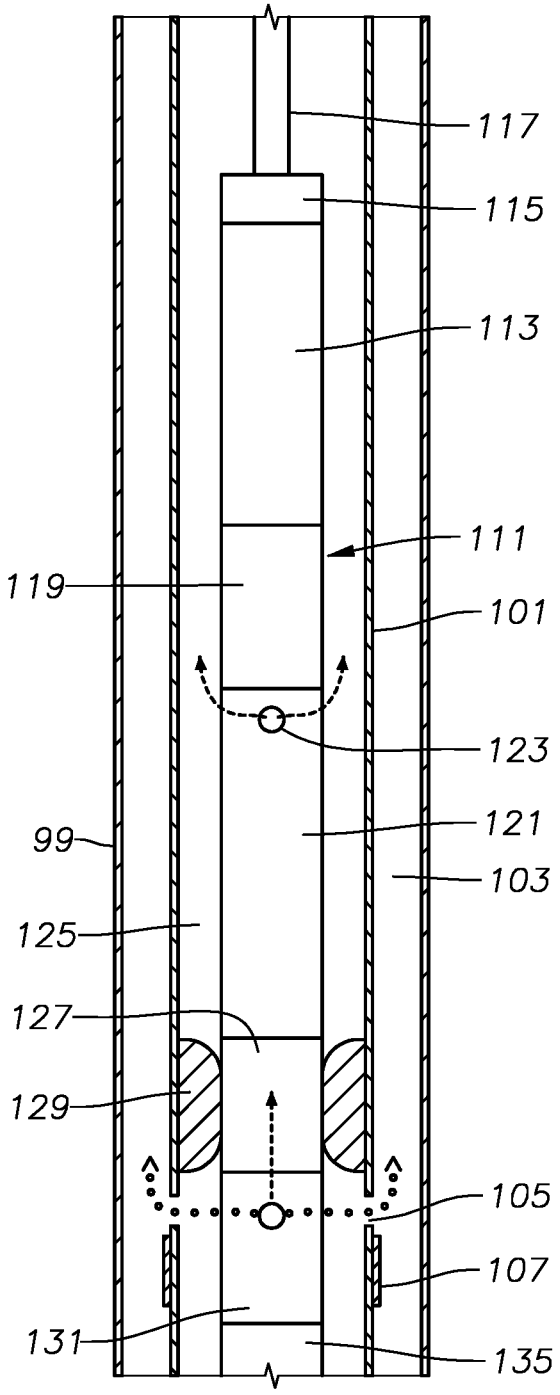
FIGS. 5A and 5B comprise a schematic side view of a coiled tubing installed ESP installation in accordance with this disclosure.
Figure 5B:
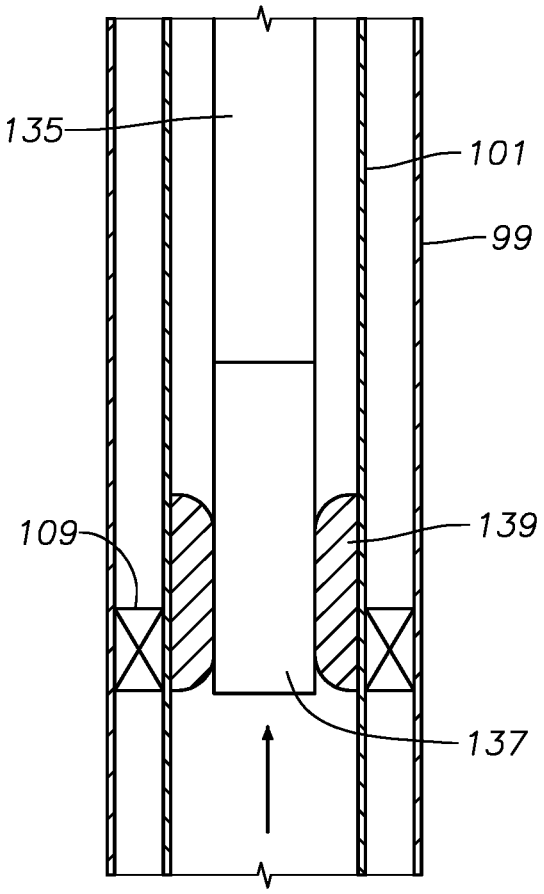

FIGS. 5A and 5B show a first alternate embodiment. The well has a string of outer conduit or casing 99, which may be cemented in the well. A wellhead (not shown) suspends a string of production tubing 101 within casing 99. Tubing 101 creates a tubing annulus 103 between tubing 101 and outer conduit 99. Tubing 101 has a tubing port 105 in its sidewall communicating its interior with tubing annulus 103. A sliding sleeve valve 107 may be mounted to tubing 101 for opening and closing tubing port 105. Sliding sleeve valve 107 may have a hydraulic line (not shown) leading down from the wellhead to actuate sliding sleeve valve 107. The lower end of tubing 101 stabs into a packer 109 that seals tubing 101 to outer conduit 99. Well fluid flows into the open lower end of tubing 101, as indicated by the solid arrow.

An ESP assembly 111 within tubing 101 has an electrical motor 113 with an adapter 115 on its upper end that connects to a string of power cable coiled tubing 117. Power cable coiled tubing 117 is a conventional type comprising flexible steel tubing containing an electrical power cable with power conductors for each phase of the three phases of motor 113.

A seal section 119 connects to the lower end of motor 113 for sealing around a drive shaft rotated by motor 113. Seal section 119 also reduces a pressure difference between dielectric lubricant in motor 113 and well fluid on its exterior.

A production pump 121 has an upper end that connects to the lower end of seal section 119. Production pump 121 may be the same as production pump 31 (FIG. 2), except that it has a well fluid discharge 123 that discharges outward into an assembly annulus 125 located between ESP assembly 111 and tubing 101.

Production pump 121 has a tubular seal member 127 on its lower end that has an exterior surface configured to slide into and seal with an upper polished bore receptacle 129 mounted in tubing 101. The drive shaft assembly extending from motor 113 through seal section 119 and production pump 121 also extends through seal member 127. Seal member 127 could be an integral portion of the housing of production pump 121.

A rotary driven gas separator 131 secures to the lower end of seal member 127. Gas separator 131 may be the same as gas separator 31 of FIG. 2. Gas separator 131 has a gas discharge 133 that directs separated gas into assembly annulus 125. Tubing ports 105 are located below polished bore receptacle 129 and either above or aligned with gas discharge 133. Thus, separated gas flowing out of gas discharge 133 flows out tubing ports 105 into tubing annulus 103, indicated by the dotted arrows.

A charge pump 135, which may be the same as charge pump 45 (FIG. 4), connects to the intake of gas separator 133. Referring to FIG. 5B, a seal member or stack 137 on the lower end of charge pump 135 slides into and seals within a lower polished bore receptacle 139, which may be a part of packer 109. Seal stack 137 is a tubular member with an open lower end for flowing well fluid into charge pump 135, as indicated by the solid arrow.

During installation of ESP assembly 111, power cable coiled tubing 117 will be deployed by a coiled tubing injector (not shown) at the wellhead. Seal member 127 slides into sealing engagement with upper polished bore receptacle 129. Seal stack 137 slides into sealing engagement with lower polished bore receptacle 139.

When power is supplied to the conductors in power cable coiled tubing 117, motor 113 will drive production pump 121, gas separator 131 and charge pump 135. Charge pump 135 draws in a well fluid mixture of liquid and gas, as indicated by the solid arrow, and discharges the mixed phase well fluid at an increased flowing pressure into gas separator 131. Gas separator 131 separates lighter components from heavier and discharges the lighter components out gas discharge 133, as indicated by the dotted arrows. The gaseous components flow through tubing ports 105 and up tubing annulus 103 to the wellhead. Gas separator 131 discharges the heavier components into production pump 121, which increases the flowing pressure and discharges the heavier components out discharge 123 into ESP assembly annulus 125, as indicated by the dashed arrows.

Figure 6A:
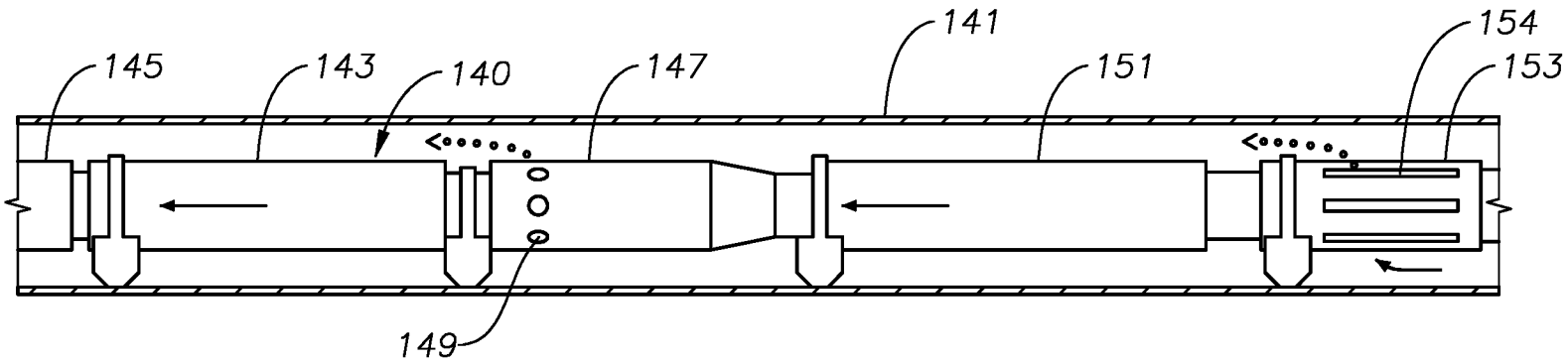
FIGS. 6A and 6B comprise a schematic side view of an ESP installation for a horizontal well section in accordance with this disclosure
Figure 6B:
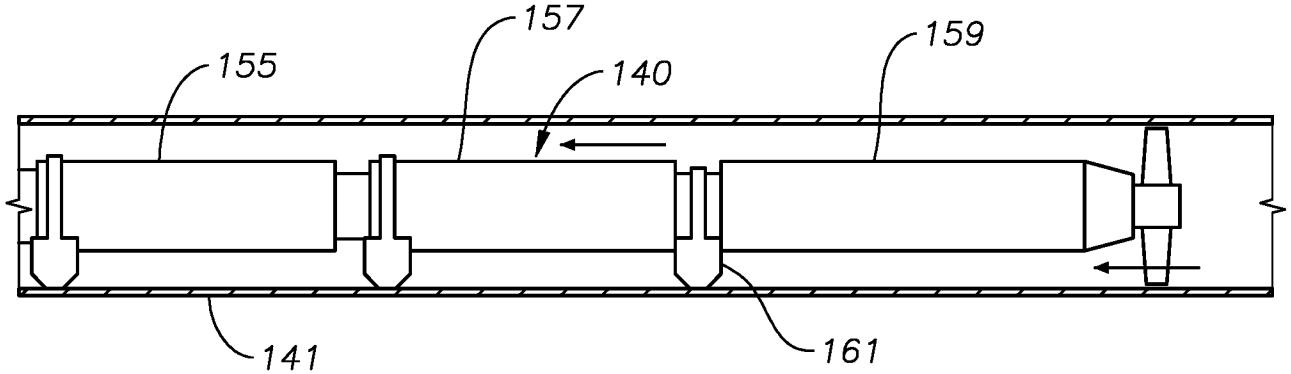

FIGS. 6A and 6B illustrate a third embodiment, which particularly applies to SAGD (steam assisted gravity drainage) wells. Outer conduit 141 is a casing or the like tubular that has a generally horizontal section containing apertures in its sidewall for steam to be injected into outer conduit 141 to reduce the viscosity of the hydrocarbon flowing into it. A production pump 143 has a discharge 145 connected to a string of production tubing (not shown). A gas separator 147 connects to the intake of production pump 143 for delivering liquid well fluid. Gas separator 147, which may be the same as gas separator 37 (FIG. 3), has a gas discharge 149 that discharges more gaseous components into outer conduit 141.

A charge pump 151, which may be the same as charge pump 45 (FIG. 4), pressurizes and discharges well fluid into the intake of gas separator 147. An optional gravity type of separator 153 may be connected to the intake of charge pump 151. Gravity separator 153 is a conventional device used in SAGD installations. It includes a tubular member with slots 154 and an internal blocking member (not shown). The internal blocking member has an counterweight that causes it to block slots 154 located on the lower side of gravity separator 153 and open those on the upper side. Well fluid containing gas and liquid flows into gravity separator 153, as indicated by the solid arrow. Gas that separates by gravity from the well fluid flowing into gravity separator 153 can flow out the open outlet slots 154 on the upper side, as indicated by the dotted arrow. Liquid flows from gravity separator 153 into the intake of charge pump 151.

A seal section 155 connects to the intake end of gravity separator 153. In this example, a second seal section 157 is connected in tandem with seal section 155. An electric motor 159 connects to the upstream seal section 157. Seal sections 155, 157 reduce a pressure differential between dielectric lubricant in motor 159 and well fluid on the exterior of motor 159. The power cable (not shown) extends alongside the production tubing to motor 159. Centralizers 161 may be at the upstream end of motor 159 and along the length of the ESP assembly.

Charge pump 151 operates in the same manner as in the other embodiments by applying a charging pressure to the intake of gas separator 147. Gas separator 147 operates more efficiently as a result in supplying separated liquid to production pump 143. Charging pump 151 reduces the tendency for well fluid flowing along outer conduit 141 around motor 159 to enter into gas separator discharge 149 instead of the intake of gas separator 147.

While only three embodiments of the disclosure have been given for purposes of disclosure, numerous changes exist in the details of procedures for accomplishing the desired results. These and other similar modifications will readily suggest themselves to those skilled in the art, and are intended to be encompassed within the scope of the appended claims.

The invention claimed is:

1. An apparatus for pumping well fluid from a well, comprising:

an electrical submersible pump assembly (ESP) comprising:

an electrical motor;

a production pump driven by the electrical motor, the production pump comprising a centrifugal pump and having a plurality of production pump stages;

a gas separator upstream from the production pump and driven by the electrical motor; and a charge pump upstream from the gas separator and driven by the electrical motor, the charge pump comprising a centrifugal pump having a plurality of charge pump stages, the charge pump having a discharge that leads to an intake of the gas separator, and each of the production pump stages has a higher lifting capacity than each of the charge pump stages.

2. The apparatus according to claim 1, wherein:

each of production pump stages has an impeller with a vane exit angle relative to a longitudinal axis of the production pump; and each of the charge pump stages has an impeller with a vane exit angle relative to the longitudinal axis of the production pump that is less than the vane exit angle of the impeller of each of the production pump stages.

3. The apparatus according to claim 1, further comprising:

a string of production tubing;

a power cable wet mate device secured to the tubing;

a power cable extending alongside an exterior of the tubing and down to the power cable wet mate device;

an adapter on an upper end of the assembly for lowering the assembly into the tubing on a wireline;

an annular seal arrangement between the production pump and the tubing;

a motor wet mate device on the electrical motor that engages the power cable wet mate device;

wherein the gas separator is mounted to a lower end of the production pump, the charge pump is mounted to a lower end of the gas separator, and the electrical motor is below the charge pump; and the apparatus further comprises:

a first port in the tubing below the wet mate devices for directing upward flowing well fluid in the tubing outward into a tubing annulus surrounding the tubing;

a second port in the tubing above the wet mate devices for directing upward flowing well fluid in the tubing annulus into the tubing and to an intake of the charge pump; and a third port in the tubing above the second port and below the annular seal arrangement for directing separated gas from the gas separator outward into the tubing annulus.

4. The apparatus according to claim 3, further comprising:

first, second and third sleeve valves that selectively open and close the first, second and third ports, respectively.

5. The apparatus according to claim 1, further comprising:

a string of production tubing;

a power cable coiled tubing adapter on an upper end of the electrical motor for connecting the assembly to a string of coiled tubing; wherein the production pump is mounted below the electrical motor and has a production pump discharge for discharging well fluid into an assembly annulus in the tubing surrounding the assembly;

the gas separator is mounted to a lower end of the production pump and has a gas separator discharge for discharging separated gas into the assembly annulus;

the charge pump is mounted to a lower end of the gas separator; and wherein the apparatus further comprises:

a seal arrangement between the tubing and the production pump below the production pump discharge and above the gas separator discharge; and a port in the tubing below the seal arrangement for directing separated gas from the gas separator discharge into a tubing annulus surrounding the tubing.

6. The apparatus according to claim 5, further comprising:

a sleeve valve that selectively opens and closes the port.

7. The apparatus according to claim 1, further comprising:

an outer conduit into which well fluid flows and which contains the assembly;

wherein the production pump has a production pump discharge for discharging well fluid into a string of tubing within the outer conduit;

the gas separator has a separated liquid discharge coupled to an intake of the production pump and has a separated gas discharge for discharging separated gas into the outer conduit;

the charge pump has a charge pump discharge connected to an intake of the gas separator; and the electrical motor is within the outer conduit upstream from the charge pump.

8. The apparatus according to claim 7, wherein the assembly further comprises:

a well fluid gravity separator at an upstream end of the charge pump for gravity separating gas from liquid in the well fluid flowing to the charge pump.

9. An apparatus for pumping well fluid from a well, comprising:

an electrical submersible pump assembly (ESP) comprising:

an electrical motor;

a production pump driven by the electrical motor, the production pump comprising a centrifugal pump and having a plurality of production pump stages, each of the production pump stages having an impeller with a vane exit angle relative to a longitudinal axis of the production pump;

a gas separator upstream from the production pump and driven by the electrical motor;

a charge pump upstream from the gas separator and driven by the electrical motor, the charge pump comprising a centrifugal pump and having a plurality of charge pump stages, the charge pump having a discharge that leads to an intake of the gas separator; and each of the charge pump stages having an impeller with a vane exit angle relative to the longitudinal axis of the production pump that is smaller than the vane exit angle of the impellers of the production pump stages.

10. The apparatus according to claim 9, wherein:

each of the production pump stages has a higher lifting capacity than each of the charge pump stages.

11. The apparatus according to claim 9, further comprising:

a string of production tubing;

a power cable wet mate device secured to the tubing;

a power cable extending alongside an exterior of the tubing and down to the power cable wet mate device;

an adapter on an upper end of the assembly for lowering the assembly into the tubing on a wireline;

an annular seal arrangement between the production pump and the tubing;

a motor wet mate device on the electrical motor that engages the power cable wet mate device;

wherein the gas separator is mounted to a lower end of the production pump, the charge pump is mounted to a lower end of the gas separator, and the electrical motor is below the charge pump; and the apparatus further comprises:

a first port in the tubing below the wet mate devices for directing upward flowing well fluid in the tubing outward into a tubing annulus surrounding the tubing;

a second port in the tubing above the wet mate devices for directing upward flowing well fluid in the tubing annulus into the tubing and to an intake of the charge pump; and a third port in the tubing above the second port and below the annular seal arrangement for directing separated gas from the gas separator outward into the tubing annulus.

12. The apparatus according to claim 9, further comprising:

a string of production tubing;

a power cable coiled tubing adapter on an upper end of the electrical motor for connecting the assembly to a string of coiled tubing; wherein the production pump is mounted below the electrical motor and has a production pump discharge for discharging well fluid into an assembly annulus in the tubing surrounding the assembly;

the gas separator is mounted to a lower end of the production pump and has a gas separator discharge for discharging separated gas into the assembly annulus;

the charge pump is mounted to a lower end of the gas separator; and wherein the apparatus further comprises:

a seal arrangement between the tubing and the production pump below the production pump discharge and above the gas separator discharge; and a port in the tubing below the seal arrangement for directing separated gas from the gas separator discharge into a tubing annulus surrounding the tubing.

13. The apparatus according to claim 9, further comprising:

an outer conduit into which well fluid flows and which contains the assembly; wherein the production pump has a production pump discharge for discharging well fluid into a string of tubing within the outer conduit;

the gas separator has a separated liquid discharge coupled to an intake of the production pump and has a separated gas discharge for discharging separated gas into the outer conduit;

the charge pump has a charge pump discharge connected to an intake of the gas separator; and the electrical motor is within the outer conduit upstream from the charge pump.

14. The apparatus according to claim 9, further comprising an inducer between the charge pump and the gas separator.

15. A method of pumping well fluid from a well, comprising:

lowering an electrical submersible pump assembly (ESP) into the well, the ESP comprising an electrical motor, a production pump that comprises a centrifugal pump with a plurality of production pump stages, a gas separator upstream from the production pump, a charge pump upstream from the gas separator, the charge pump comprising a centrifugal pump having a plurality of charge pump stages, the charge pump having a discharge that leads to an intake of the gas separator;

powering the electrical motor to drive the centrifugal pump, the gas separator and the charge pump;

flowing well fluid containing heavier and lighter components into the charge pump, increasing a flowing pressure of the well fluid with the charge pump, and discharging all of the well fluid entering the charge pump into the gas separator;

with the gas separator, separating the lighter components from the heavier components, discharging the lighter components exterior of the production pump, and flowing the heavier components into the production pump; and with the production pump, pumping the heavier components to a wellhead, each of production pump stages has an impeller with a vane exit angle relative to a longitudinal axis of the production pump; and each of the charge pump stages has an impeller with a vane exit angle relative to the longitudinal axis of the production pump that is less than the vane exit angle of the impeller of each of the production pump stages.

16. The method according to claim 15, wherein:

each of the production pump stages has a higher lifting capacity than each of the charge pump stages, enabling larger volumes of lighter components to flow through the charge pump than the production pump.

17. The method according to claim 15, further comprising:

homogenizing the well fluid flowing from the charge pump with an inducer prior to separating the lighter and heavier components with the gas separator.

18. The method according to claim 15, further comprising:

connecting a gravity separator into the ESP upstream from the charge pump, and separating heavier components from lighter components of the well fluid prior to flowing into the charge pump.

* * * * *